United States Patent [19]

Marzoli

[11] 4,255,925

[45] Mar. 17, 1981

[54] SECTIONAL SCAFFOLDING FOR SPINNING, TWISTING AND LIKE FRAMES

[75] Inventor: Angelo Marzoli, Palazzlo Sull'oglio, Italy

[73] Assignee: F.lli Marzoli & C. S.p.A., Italy

[21] Appl. No.: 30,685

[22] Filed: Apr. 16, 1979

[30] Foreign Application Priority Data

Apr. 24, 1978 [IT] Italy ..... 22685 A/78

[51] Int. Cl.[3] ..... D01H 1/16; D01H 11/00

[52] U.S. Cl. ..... 57/304; 57/1 R; 57/136

[58] Field of Search ..... 57/1 R, 304, 305, 136, 57/137

[56] References Cited

U.S. PATENT DOCUMENTS

| | | | |
|---|---|---|---|
| 2,128,207 | 4/1938 | Hodge | 57/304 |
| 2,744,295 | 5/1956 | Spisak | 57/304 X |
| 2,758,439 | 8/1956 | Bradshaw | 57/136 |
| 2,946,174 | 7/1960 | Bahnson, Jr. | 57/304 |
| 2,977,181 | 3/1961 | Reiterer | 57/304 |
| 2,994,182 | 8/1961 | Leutert | 57/1 R |
| 3,018,503 | 1/1962 | Hijiya et al. | 57/304 X |
| 3,059,896 | 10/1962 | Reiterer | 57/304 X |
| 3,429,745 | 2/1969 | Black, Jr. | 57/304 X |

FOREIGN PATENT DOCUMENTS 550248 12/1942 United Kingdom .

*Primary Examiner*—John Petrakes
*Attorney, Agent, or Firm*—Karl W. Flocks

[57] ABSTRACT

The scaffolding intended for supporting the entire structure of a spinning frame or a like machine is made of individual intermediate sections which are united to a header and a tail section and are serially connected to each other in the intermediate portion of the machine. Each section is composed by two spaced apart shell-like sidewalls connected together by tubular longitudinally extending members. The sections are united by bolting them together so that the tubular members form conduits for removing linters and like airborne materials sucked by an exhauster. Sound-absorbing slabs are inserted between every two adjoining section sidewalls to diminish the noise level.

3 Claims, 4 Drawing Figures

SECTIONAL SCAFFOLDING FOR SPINNING, TWISTING AND LIKE FRAMES

This invention relates to spinning machines, twisting frames and the like and is particularly concerned with the scaffolding for such machines.

It is known that such machines have, usually on two opposite sides, a plurality of processing stations and thus possess a considerable longitudinal extension.

In order that the manufacture, assembly and shipping costs may be reduced, and also with a view to possible enlargements in the future, it has been suggested that the scaffolding for such machines be composed by a plurality of individual modular sections made more or less in the same way.

By so doing, it becomes possible to construct in a factory the individual modular sections, to ship them individually to the place in which the complete machine is to be erected, and to provide on the spot to the assemblage of the machine by connecting together the modular sections in the desired number. The advantages stemming from such a composition method of the machine are apparent, since such machines would be very difficult to ship as an integral operative unit.

The conventional approaches, however, do not seem to be concerned with the problems inherent in the reduction of acoustic and environmental pollution.

An object of the present invention is to provide a scaffolding comprised of a plurality of individual structural sections for spinning, twisting and like frames, which, in addition to reducing manufacturing or initial costs, the costs of assembling and shipping, is capable of giving a low level of noise during the machine run while concurrently enabling removal of airborne dust which would otherwise be introduced into the workshop in which the machine has been installed.

In order that such an object may be achieved, the invention suggests a scaffolding made of individual modular structural sections of the same configuration, to be arranged between a head unit and a tail unit, characterized in that each modular structural section comprises two shell-like parallel vertical walls spaced apart from one another and connected by longitudinally extending structural tubular members, two at least of which are hollow and are arranged the one above the other with the center on the vertical central axis of said walls, whereas other longitudinally extending structural members are arranged laterally of said walls and are intended to carry the machine spindles, said lateral structural members being susceptible of being laid on the ground by vertical supporting members, the top hollow member, in addition to acting as a supporting structure for functional component parts of the machine, such as draw-frames, creels and the like, being equipped with suction mechanisms associated to the individual processing stations, whereas the bottom hollow member is equipped with a port directed downward, said top and bottom hollow members forming, when the structural sections have been assembled together, conduits to be connected to suction and filtering units, sound-dampening means being inserted between adjoining vertical walls of consecutive structural sections in order that the noise level of the running machine may be lowered.

In the structural sections of the scaffolding according to the invention, the hollow tubular members thus fulfil the twofold requirement of acting as structural and supporting component parts, and that of acting as manifolds for exhausting airborne threads, fibrils, dust and other impurities from the room in which the machine concerned has been erected. In addition, the sound-dampening means inserted between adjoining structural sections of the scaffolding, considerably reduce the noise-level.

Further features and advantages of the invention will become apparent from the ensuing description of exemplary embodiments, reference being had to the accompanying drawings, wherein.

Figure 4:
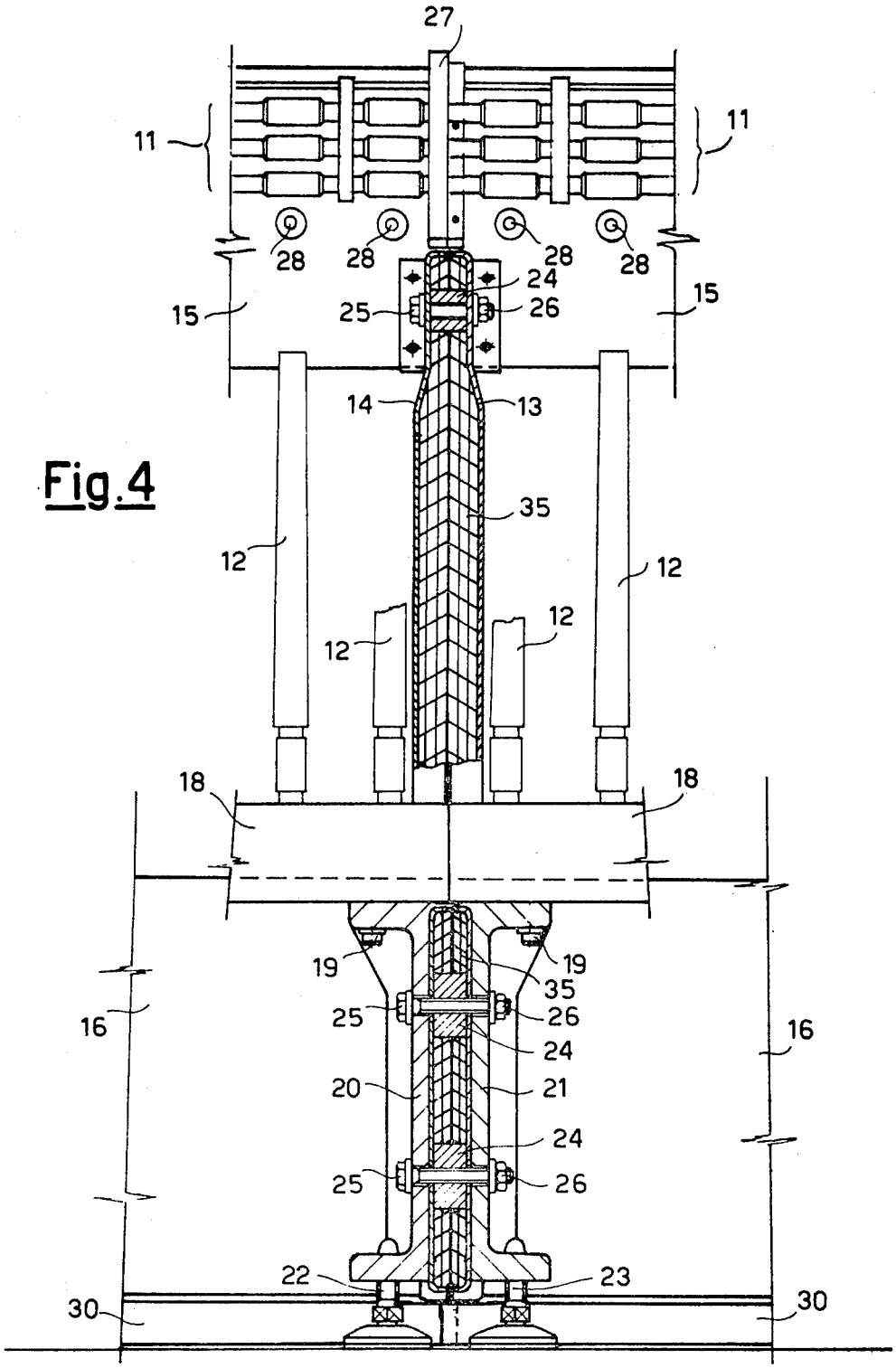
FIG. 4 shows, partly in cross-sectional view taken along the line IV—IV of FIG. 3, the detail of the joint between two adjoining structural sections.

It is to be borne in mind that the drawings, with the exception of FIG. 4, are all diagrammatical and show, in practice, only the outline of the scaffolding for a spinning or a doubling frame: of the component parts and the functional members of the machine, only those details which are essential for a fair understanding of the invention have diagrammatically been indicated.

It is understood that these component parts and members are physically embodied in a manner well known in the art, so that they do not require any more detailed illustration or dislosure.

Figure 1:
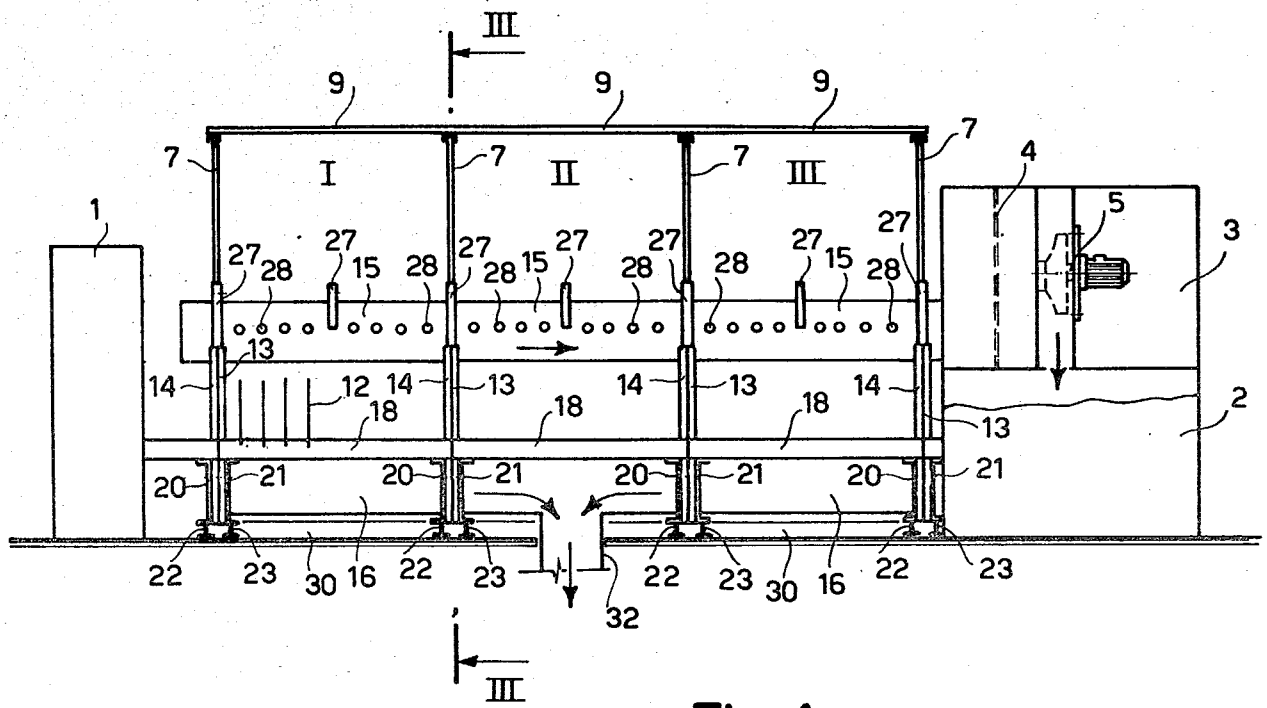
FIGS. 1 and 2 are diagrammatical elevational views of two embodiments of the scaffolding according to the invention, as comprised of three structural sections.
Figure 2:
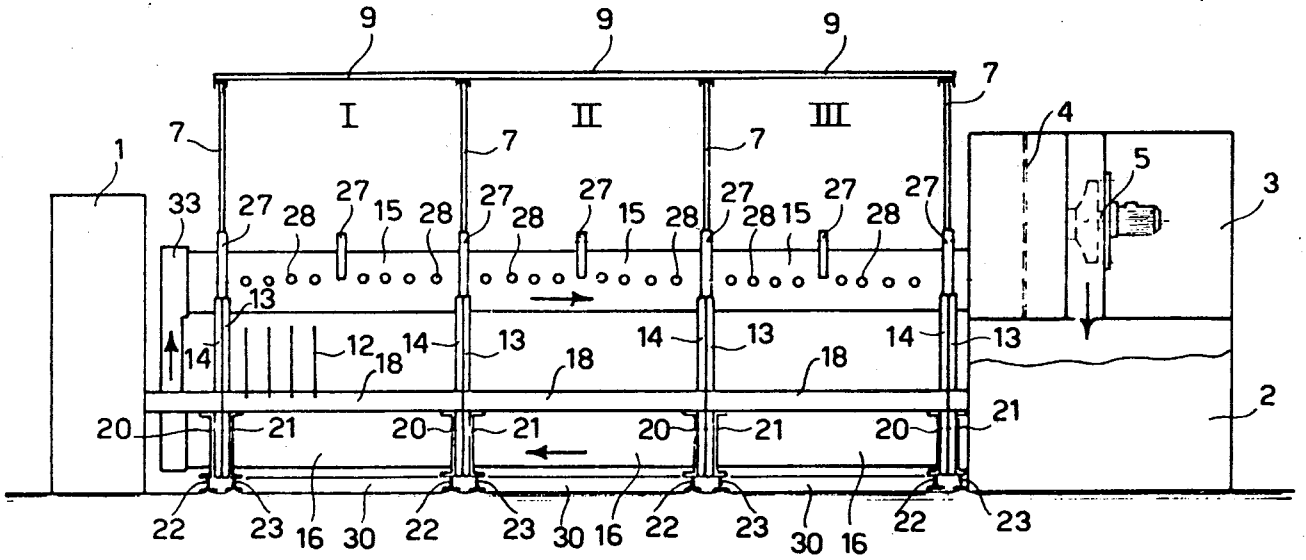

FIGS. 1 and 2 show two embodiments, very akin to one another, of a scaffolding for a spinning frame, according to the invention. The scaffolding is composed by a header 1, containing the operative linkages, by machine sections, for example in the number of three, I–II–III and an end portion, or tail, which comprises in its bottom portion 2, the motor (not shown) for driving the spindles and the linkages of the header and, in its top portion, a filter box 3 having a filter 4 and a motorized exhauster 5.

Figure 3:
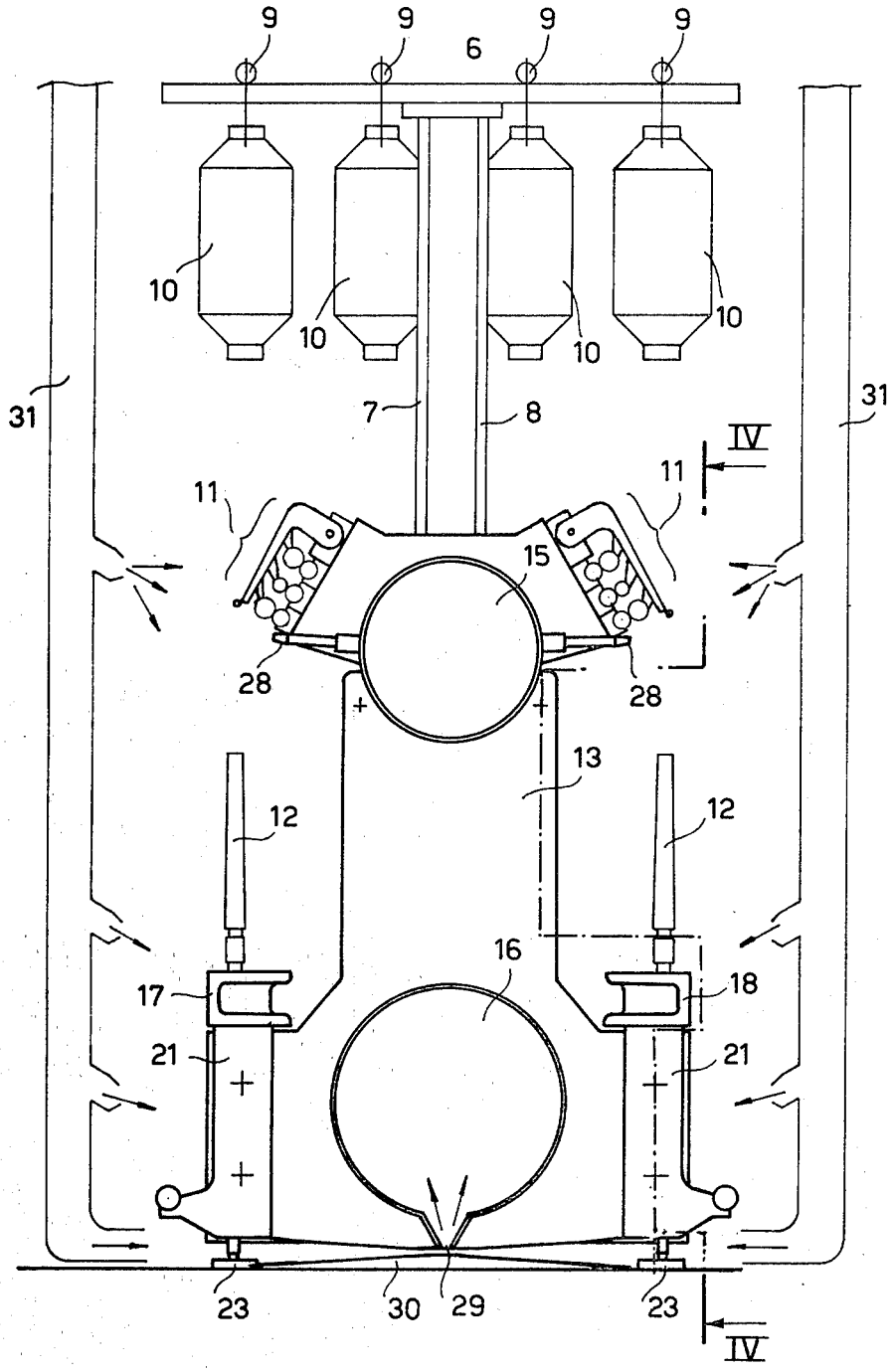
FIG. 3 is a diagrammatical vertical cross-sectional view, taken along the line III—III of FIG. 1.

Each section, such as I–II–III is composed by an equal number of conventional component parts, as shown in FIG. 3, which serve for spinning, such as the creel 6 comprising uprights 7, 8 and longitudinally extending members 9, on which bobbins 10 are hung, as obtained from the machine upstream of the spinning frame, the draw-frame 11, the spindles 12, and others.

In addition, each section comprises, according to the invention, two vertical sidewalls 13 and 14, of sheet metal, made of steel and in the form of a shell, which support four longitudinally extending structural members, 15, 16, 17 and 18: of these latter, members 15 and 16 are hollow and are positioned on atop and the other on the bottom, with their centers on the vertical central axis of the sidewalls 13 and 14, whereas the other two members 17 and 18 are made of pig iron and have a channel-like cross-sectional outline. Members 17 and 18 are mounted laterally of the sidewalls 13 and 14 and with spindles 12 being mounted on the members 17 and 18 aforementioned.

The members 17 and 18 are connected by screws 19 (best viewed in FIG. 4) to two uprights 20 and 21 which rest on the ground with the intermediary of two level-adjustable feet 22 and 23.

The junction of two adjoining sections, according to the invention, is assembled at the plane of the vertical sidewalls, that is to say by conjoining the sidewalls 13 and 14 with spacer blocks 24 inserted therebetween, the conjunction being obtained with the screws 25 and the nuts 26.

In addition, between the sidewalls 13 and 14 sound-dampening slabs 35 are interposed.

On the top hollow longitudinal 15, there are mounted at certain intervals, supporting members 27 which are screwably fastened to such longitudinal and bear the draw rollers of the draw frame 11 and the pillars 7 and 8 of the creel.

All the hollow members 15, as the sections I–II–III are brought together, make up a lengthy channel on which suction tubes 28 (one for each processing station) are mounted for sucking the threads. At the tail portion, the channel is connected to the filter box 3, so as to have an airstream flowing therethrough under a negative pressure, as generated by the motorized exhauster 5.

The bottom member 16, has in its lower portion, a longitudinal slit 29: when the sections I–II–III are brought together, the longitudinals 16 make up a second channel.

Under the slit 29 a steel sheet triangular member 30 is applied so as to convey the airborne fibrils and impurities, with the aid of the traveling blower, conventional and diagrammatically shown in FIG. 3 as the tubes 31, into the channel formed by the bottom members 16.

In addition, the airborne particles and impurities are drawn into the channel 16 since the latter is connected by one more tubular members 32, to the centralized mainfolds which communicate with the air conditioning unit after that the air has been filtered.

Another embodiment has been shown in FIG. 2, wherein the lower channel is connected to the top channel by a pipe 33.

It is apparent from the foregoing description that the scaffolding according to the invention can be composed by any desired number of individual structural sections which provide hollow component parts, which, after that the sections have been brought together, make up channels through which airborne dust, fibrils, threads and other impurities are drawn away. In addition, by virtue of the insertion of sound-lampening slabs in correspondence with the junction lines between adjoining sections, the noise level of the running machines is considerably reduced.

I claim:

1. Scaffolding for spinning, twisting and like frames including a plurality of longitudinally disposed modular structural sections situated between a head unit and a tail unit with a plurality of longitudinally extending structural members interconnecting each of said structural sections characterized:

(a) in that each of said structural sections comprises two shell-like parallel vertical walls spaced apart from one another with sound-dampening means disposed therebetween whereby noise level will be minimized;

(b) in that at least two of said structural members are hollow and are situated one above the other with their centers located on the vertical central axis of said vertical walls;

(c) in that others of said structural members than said hollow structural members are situated laterally of said vertical walls, connect said vertical walls laterally thereof, and are adaptable to being laid on the ground;

(d) in that the upper one of said hollow structural members is operably connected with suction means for operation at individual processing stations, the lower one of said hollow structural members is equipped with a downwardly directed port, and said upper and lower hollow members form conduits with connection means for filtering means for use in conjunction with said suction means.

2. Scaffolding as defined in claim 1, characterized in that at least one tubular member extends from said lower one of said hollow members for connection to a centralized manifold communicating with a unit for conditioning air from said lower one of said hollow members.

3. Scaffolding as defined in claim 1, characterized in that said conduits formed by said upper and lower hollow members are connected to each other at the ends thereof adjacent said head unit and the conduit formed by said upper hollow member is connected to a filter box fitted with a motorized exhauster at the end of said upper hollow member adjacent said tail unit.

* * * * *